US009278528B2

(12) United States Patent
Akahane

(10) Patent No.: US 9,278,528 B2
(45) **Date of Patent: *Mar. 8, 2016**

(54) LIQUID EJECTING HEAD AND LIQUID EJECTING APPARATUS

(71) Applicant: Seiko Epson Corporation, Shinjuku-ku (JP)

(72) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/497,087

(22) Filed: Sep. 25, 2014

(65) Prior Publication Data

US 2015/0077472 A1 Mar. 19, 2015

Related U.S. Application Data

(63) Continuation of application No. 14/024,477, filed on Sep. 11, 2013, now Pat. No. 8,870,347, which is a continuation of application No. 13/422,929, filed on Mar. 16, 2012, now Pat. No. 8,556,383.

(30) Foreign Application Priority Data

Mar. 22, 2011 (JP) ..... 2011-062531

(51) Int. Cl.
*B41J 2/15* (2006.01)
*B41J 2/14* (2006.01)

(52) U.S. Cl.
CPC ..... *B41J 2/1433* (2013.01); *B41J 2/14233* (2013.01); *B41J 2002/14241* (2013.01); *B41J 2002/14419* (2013.01); *B41J 2002/14491* (2013.01); *B41J 2202/03* (2013.01)

(58) Field of Classification Search
CPC ..... B41J 2/04541; B41J 2/0458; B41J 2/07; B41J 29/38; B41J 2/1433; B41J 2/162; B41J 2/135; B41J 2/14145; B41J 2002/14411; B41J 2002/14467
See application file for complete search history.

(56) References Cited

U.S. PATENT DOCUMENTS 6,193,360 B1 2/2001 Nishiwaki et al.
7,878,631 B2 2/2011 Kuriki et al.

(Continued)

FOREIGN PATENT DOCUMENTS

JP 09-314863 A 12/1997
JP 2002-187283 A 7/2002

(Continued)

OTHER PUBLICATIONS

Non-Final Rejection of Feb. 28, 2014 in related U.S. Appl. No. 14/024,477—6 pages.

(Continued)

*Primary Examiner* — Lamson Nguyen
(74) *Attorney, Agent, or Firm* — Kilpatrick Townsend & Stockton LLP

(57) ABSTRACT

A liquid ejecting head includes: a flow channel member made of silicon; a nozzle plate made of silicon; a manifold member, which cooperates with the flow channel member to define a manifold in fluid communication with a plurality of pressure generation chambers; and a cover member, wherein the cover member is made of a different material than the nozzle plate, and wherein the cover member is affixed to the surface of the flow channel member that is affixed to the nozzle plate. The cover member fluidly blocks the manifold from the ambient atmosphere.

5 Claims, 4 Drawing Sheets

(56) References Cited

U.S. PATENT DOCUMENTS

| | | | | |
|---|---|---|---|---|
| 7,980,679 | B2 | 7/2011 | Seto et al. | |
| 8,556,383 | B2 * | 10/2013 | Akahane | 347/47 |
| 2002/0075361 | A1 | 6/2002 | Kanda et al. | |
| 2006/0092237 | A1 | 5/2006 | Kwon et al. | |
| 2010/0315471 | A1 | 12/2010 | Kihira et al. | |

FOREIGN PATENT DOCUMENTS

| | | | |
|---|---|---|---|
| JP | 3402349 | B2 | 2/2003 |
| JP | 2005-014505 | A | 1/2005 |
| JP | 2006-051746 | A | 2/2006 |
| JP | 2006-130917 | A | 5/2006 |
| JP | 2009-226650 | A | 10/2009 |
| JP | 2011-000714 | A | 1/2011 |

OTHER PUBLICATIONS

Notice of Allowance of Jun. 17, 2013 in related U.S. Appl. No. 13/422,929—10 pages.

* cited by examiner

LIQUID EJECTING HEAD AND LIQUID EJECTING APPARATUS

CROSS REFERENCE TO RELATED APPLICATIONS

This application is a continuation of U.S. application Ser. No. 14/024,477, filed Sep. 11, 2013, which is a continuation of U.S. application Ser. No. 13/422,929 filed on Mar. 16, 2012 (now U.S. Pat. No. 8,556,383), which claims priority to Japanese Patent Application No. 2011-062531 filed on Mar. 22, 2011, the entireties of all which are hereby expressly incorporated by reference herein.

BACKGROUND

1. Technical Field

The present invention relates to liquid ejecting heads that eject liquid from nozzles and liquid ejecting apparatuses, and particularly relates to ink jet recording heads that eject ink as a liquid and ink jet recording apparatuses.

2. Related Art

As an example of a liquid ejecting head that ejects liquid droplets, there is an ink jet recording head that, for example, includes pressure generation chambers that communicate with nozzles and piezoelectric actuators provided opposite to corresponding pressure generation chambers, and that ejects ink droplets from the nozzles by causing a change in pressure to occur within the pressure generation chambers as a result of displacement of the piezoelectric actuators.

Various structures have been proposed for such ink jet recording heads, but generally speaking, the head is configured by affixing a plurality of members to each other using an adhesive or the like (for example, see Japanese Patent No. 3402349).

In this manner, an ink flow channel in the ink jet recording head is generally formed by a plurality of members. Because the shape of the ink flow channel has a large influence on the ejection properties of the ink, it is preferable for the ink flow channel to be formed with a comparatively high degree of precision. Furthermore, it is desirable to increase the density at which the nozzles are formed in order to increase the printing quality. Accordingly, in recent years, flow channels, nozzles, and so on have been formed by using a silicon substrate as the material for the members of which the head is configured, and by etching the silicon substrate.

By using a silicon substrate in this manner, the flow channel, nozzles, and so on can be formed with a comparatively high degree of precision and at a high density. However, silicon substrates are a comparatively expensive material, and there is thus a problem in that using a silicon substrate will lead to an increase in costs.

It should be noted that this problem is not limited to ink jet recording heads that eject ink, and is also present in other liquid ejecting heads that eject liquids aside from ink.

SUMMARY

It is an advantage of some aspects of the invention to provide a liquid ejecting head and a liquid ejecting apparatus capable of suppressing an increase in costs while improving liquid droplet ejection properties.

A liquid ejecting head according to an aspect of the invention includes: a flow channel formation member, configured of silicon, that includes a plurality of pressure generation chambers that communicate with corresponding nozzles that eject a liquid; a nozzle plate, configured of silicon, that is affixed to the flow channel formation member and in which the nozzles are formed; a manifold member that is anchored to the flow channel formation member on the opposite side as the nozzle plate and that, along with the flow channel formation member, defines part of a manifold that communicates with the plurality of pressure generation chambers; and a cover member that is affixed to the manifold member and to the surface of the flow channel formation member that is affixed to the nozzle plate and that seals the manifold. Here, the cover member is formed of a different material from the nozzle plate and is anchored at a distance from the nozzle plate.

According to this aspect of the invention, it is possible to improve the liquid droplet ejection properties, as well as suppress an increase in costs by reducing the amount of silicon used.

Here, it is preferable for the cover member to include a compliance portion that is flexible. If the compliance portion is formed in a flow channel formation substrate that is configured of silicon, the manufacturing costs will increase. However, by providing the compliance portion in the cover member, it is easier to process the silicon, and the manufacturing costs are further reduced.

In addition, it is preferable for the cover member and the nozzle plate to have approximately the same thickness in the direction in which the liquid is ejected. Accordingly, a non-planarity is not formed between the cover member and the nozzle plate, which makes it possible to favorably wipe the nozzle surface of the head.

Furthermore, for example, it is preferable that the flow channel formation member include a flow channel formation substrate in which the pressure generation chambers are formed and a communication plate that is affixed to the surface of the flow channel formation substrate that is the opposite side of the manifold member and in which communication holes that communicate with corresponding pressure generation chambers are formed; and the nozzle plate is affixed to the communication plate, and the nozzles and the pressure generation chambers communicate via the communication holes.

According to such a configuration, it is possible to favorably eject even comparatively high-viscosity liquids from the nozzles, as compared to a configuration in which the nozzles communicate directly with the pressure generation chambers.

Furthermore, in this case, it is preferable for the inner diameter of the communication holes to be greater than the inner diameter of the nozzles. Accordingly, it is possible to even more favorably eject a comparatively high-viscosity liquid.

It is preferable that a liquid ejecting apparatus according to another aspect of the invention include such a liquid ejecting head. According to this aspect of the invention, a liquid ejecting apparatus having favorable ejection properties can be realized at a comparatively low cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail hereinafter based on embodiments.

Figure 1:
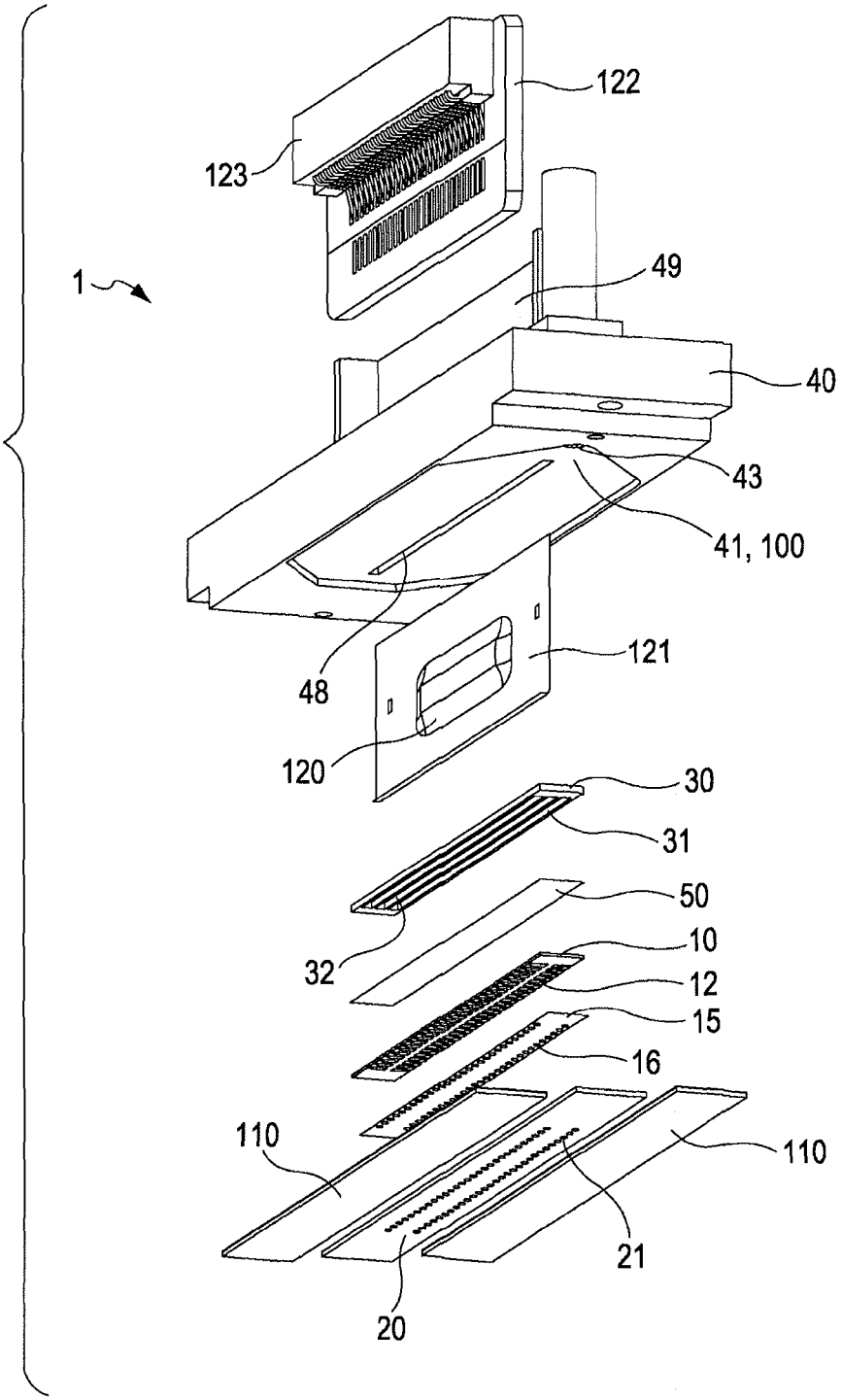
FIG. 1 is an exploded perspective view of a recording head according to an embodiment.
Figure 2A:
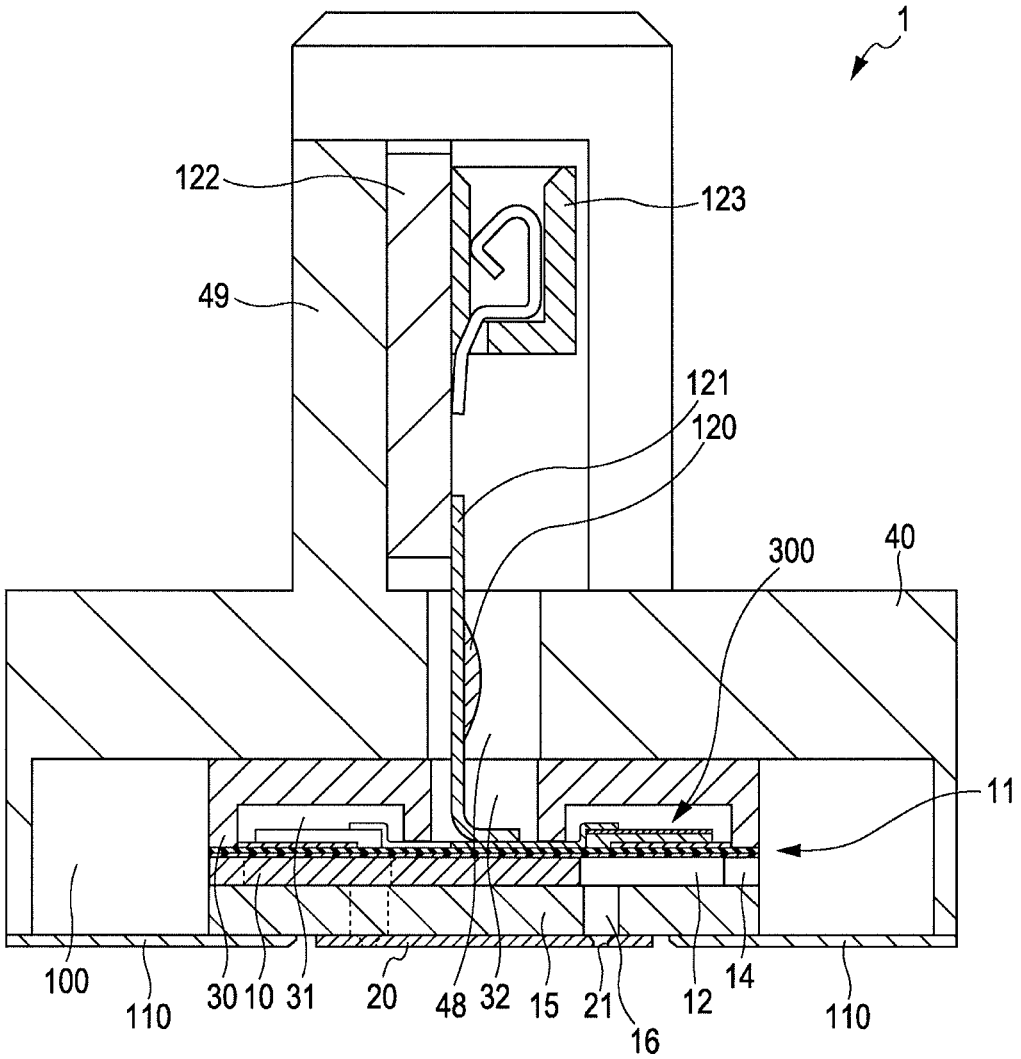
FIGS. 2A and 2B are cross-sectional views, respectively, of the recording head according to the embodiment.
Figure 2B:
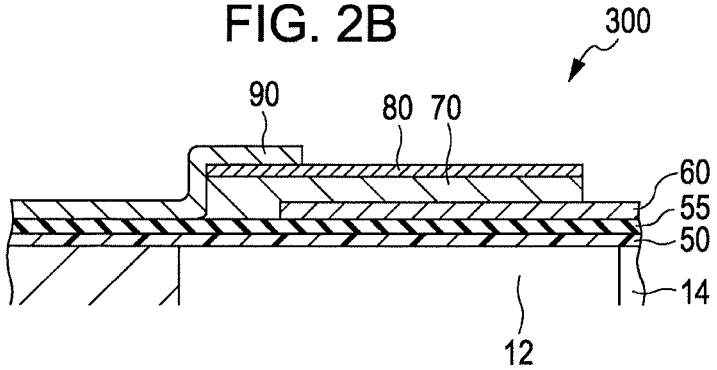

FIG. 1 is an exploded perspective view illustrating an ink jet recording head serving as an example of a liquid ejecting head according to an embodiment of the invention, and FIGS. 2A and 2B are cross-sectional views following the lengthwise direction of pressure generation chambers in the ink jet recording head.

As shown in FIGS. 1, 2A, and 2B, an ink jet recording head 1 includes a main head unit 11 and a case member 40 inside which the main head unit 11 is housed. In this embodiment, the main head unit 11 is configured of a flow channel formation substrate 10 and a communication plate 15 serving as flow channel formation members, a nozzle plate 20, and a protective substrate 30.

Two rows of a plurality of pressure generation chambers 12 are formed in the flow channel formation substrate 10, with the pressure generation chambers 12 being arranged in the width direction of the flow channel formation substrate 10. An ink supply channel 14 is provided on one side of the lengthwise direction of the pressure generation chambers 12 in the flow channel formation substrate 10. The flow channel formation substrate 10 is configured of silicon, and in this embodiment, is configured of a plane-oriented (110) silicon single-crystal substrate. An elastic membrane 50, which is configured of silicon dioxide, is formed on one surface of the flow channel formation substrate 10. This elastic membrane 50 is formed by heating the flow channel formation substrate 10 in a diffusion furnace or the like and thermally oxidizing the surface thereof. The pressure generation chambers 12 and the ink supply channel 14 are formed at a comparatively high degree of precision by carrying out anisotropic etching on the flow channel formation substrate 10, which is a silicon substrate. One surface of the pressure generation chambers 12 and the ink supply channel 14 is configured by the elastic membrane 50.

Meanwhile, the communication plate 15 is affixed to the opening surface side (that is, the opposite side as the elastic membrane 50) of the flow channel formation substrate 10. The nozzle plate 20, in which a plurality of nozzles 21 that communicate with respective pressure generation chambers 12 are provided, is affixed to the communication plate 15. Communication holes 16 that connect the pressure generation chambers 12 with corresponding nozzles 21 are provided in the communication plate 15. The communication plate 15 and the nozzle plate 20 are, like the flow channel formation substrate 10, formed of a silicon substrate, and the communication holes 16 and nozzles 21 are also formed with a high degree of precision through anisotropic etching.

The communication plate 15 and the nozzle plate 20 are formed at a comparatively small size that is approximately the same size as the flow channel formation substrate 10. By ensuring a comparatively small surface area for the flow channel formation substrate 10, the communication plate 15, and the nozzle plate 20, which are configured of a silicon substrate, it is possible to reduce the amount of silicon substrate that is used, which in turn makes it possible to achieve a reduction in material costs.

An insulation film 55 configured of an oxidized film that is a material different from the elastic membrane 50 is formed upon the elastic membrane 50, which in turn is formed upon on the flow channel formation substrate 10. Piezoelectric actuators (pressure generation units) 300, each configured of a first electrode 60, a piezoelectric layer 70, and a second electrode 80, are provided upon the insulation film 55. In this embodiment, the first electrode 60 functions as a common electrode that is shared by a plurality of piezoelectric actuators 300, whereas the second electrode 80 functions as an individual electrode provided independently for each piezoelectric actuator 300. Meanwhile, one end of each of lead electrodes 90 is connected to corresponding second electrodes 80. The other ends of the lead electrodes 90 are connected to a wiring board 121 in which is provided a driving circuit 120.

The protective substrate 30, which has approximately the same size as the flow channel formation substrate 10, is affixed to the surface of the flow channel formation substrate 10 that faces the piezoelectric actuators 300. The protective substrate 30 has a holding portion 31 serving as a space for protecting the piezoelectric actuators 300. Furthermore, a through-hole 32 is provided in the protective substrate 30. The other ends of the lead electrodes 90 extend so as to be exposed within this through-hole 32, and the lead electrodes 90 and wiring board 121 are electrically connected within the through-hole 32.

Furthermore, the case member 40 that houses the main head unit 11 configured in this manner is anchored to the main head unit 11. This case member 40 also functions as a manifold member that, along with the main head unit 11, defines a manifold that communicates with the plurality of pressure generation chambers 12. The case member 40 includes a depression area 41 in which the main head unit 11, which includes the flow channel formation substrate 10, the communication plate 15, the nozzle plate 20, and the protective substrate 30, is housed. This depression area 41 forms an opening whose area is greater than that of the flow channel formation substrate 10, and manifolds 100 are defined by the case member 40 and the main head unit 11 on both sides of the flow channel formation substrate 10 in the lengthwise direction of the pressure generation chambers 12. The open surfaces of the manifolds 100 are sealed by corresponding cover members 110. In other words, the cover members 110 are affixed to the outer peripheral areas of the communication plate 15 and the case member 40, and the openings of the manifolds 100 are sealed as a result.

Here, the cover members 110 are configured of a material that is different from the nozzle plate 20, which is configured of a silicon substrate; that is, the cover members 110 are configured of stainless steel (SUS), a polyimide film, or the like, and are provided so as to be distanced from the nozzle plate 20. In other words, the manifolds 100 that are defined by the main head unit 11 and the case member 40 are sealed by the cover members 110, which are configured of a material that is different from the nozzle plate 20.

In this manner, according to the invention, the various members of which the main head unit 11 that forms the flow channels is configured are formed from a silicon substrate, and the manifolds 100 are sealed by the cover members 110, which are configured of a material that is different from a silicon substrate. Through this, it is possible both to improve the ink ejection properties by forming the flow channels including the pressure generation chambers 12, the nozzles 21, and so on with a high degree of precision, and to achieve a reduction in costs. In other words, the overall amount of silicon substrate that is used in the ink jet recording head 1 can be reduced, which in turn makes it possible to achieve a reduction in materials costs. Furthermore, because the amount of processing carried out for the silicon substrate is reduced as a result of the reduction in the amount of silicon substrate that is used, it is furthermore possible to achieve a reduction in processing costs, a reduction in investment costs associated with facilities, and so on.

In addition, according to this embodiment, the pressure generation chambers 12 and the nozzles 21 communicate with each other via the communication holes 16 that are provided in the communication plate 15. By the communication holes 16 being present between the pressure generation chambers 12 and the nozzles 21 in this manner, the ink is suppressed from thickening, which makes it possible to favorably eject even inks that have a comparatively high level of viscosity. In particular, it is preferable for the inner diameter of the communication holes 16 to be greater than the inner diameter of the nozzles 21. Through this, thickening of the ink can be suppressed even more effectively.

Of course, because the communication plate 15 is configured of a silicon substrate, providing the communication plate 15 will result in a corresponding increase in costs. However, as described above, by sealing the manifolds 100 using the cover members 110, the amount of silicon substrate used in the head as a whole is suppressed even in the case where the communication plate 15 is provided, which in turn makes it possible to suppress the costs of the ink jet recording head as a whole.

Meanwhile, although no particular limitations are placed on the thickness of the cover members 110, the cover members 110 are, in this embodiment, formed so as to be comparatively thin, and are approximately the same thickness as the nozzle plate 20. The cover members 110 function as compliance portions that are flexible to a degree that allows deformation as a result of pressure changes within the manifolds 100. Accordingly, it is extremely easy to form the compliance portions, which also makes it possible to achieve a reduction in the manufacturing costs. Although the entirety of the cover members 110 function as compliance portions in this embodiment, only part of the cover members 110 may of course function as compliance portions.

Furthermore, although no particular limitations are placed on the thickness of the cover members 110, forming the cover members 110 at approximately the same thickness as the nozzle plate 20, as in this embodiment, makes it possible, through a wiping process, to favorably remove ink that has adhered to the nozzle surface. For example, if the thickness of the cover members 110 differs from the thickness of the nozzle plate 20 and a non-planarity is formed at the borders between the two as a result, there is a risk that the nozzle surface cannot be wiped in a favorable manner. In other words, it is preferable for the thicknesses of the cover members 110 and the nozzle plate 20 in the direction in which the ink droplets are ejected to be approximately the same, so that the nozzle surface can be wiped in a favorable manner.

Note that an introduction channel 43 that communicates with the manifolds 100 and supplies ink to the manifolds 100 is provided in the case m ember 40 (see FIG. 1). Furthermore, a connection opening 48 that communicates with the through-hole 32 of the protective substrate 30 and into which the wiring board 121 is inserted is provided in the case member 40. Further still, the case member 40 includes a wall portion 49 on the edge of the opening of the connection opening 48. The wiring board 121 and a connection board 122 connected to the wiring board 121 are affixed to this wall portion 49. The connection board 122 is configured of, for example, a rigid substrate provided with a connector 123 to which external wires are connected.

According to the ink jet recording head 1 configured in this manner, when ink is ejected, first, ink is imported through the introduction channel 43 from an ink cartridge or the like, and the interior of the flow channel, spanning from the manifolds 100 to the nozzles 21, is filled with ink. Thereafter, based on signals from the driving circuit 120, voltages are applied to the respective piezoelectric actuators 300 that correspond to the pressure generation chambers 12, and the elastic membrane 50 and insulation film 55 bend and deform along with the piezoelectric actuators 300 as a result. Through this, the pressure within the pressure generation chambers 12 increases, and ink droplets are ejected from predetermined nozzles 21.

Figure 3:
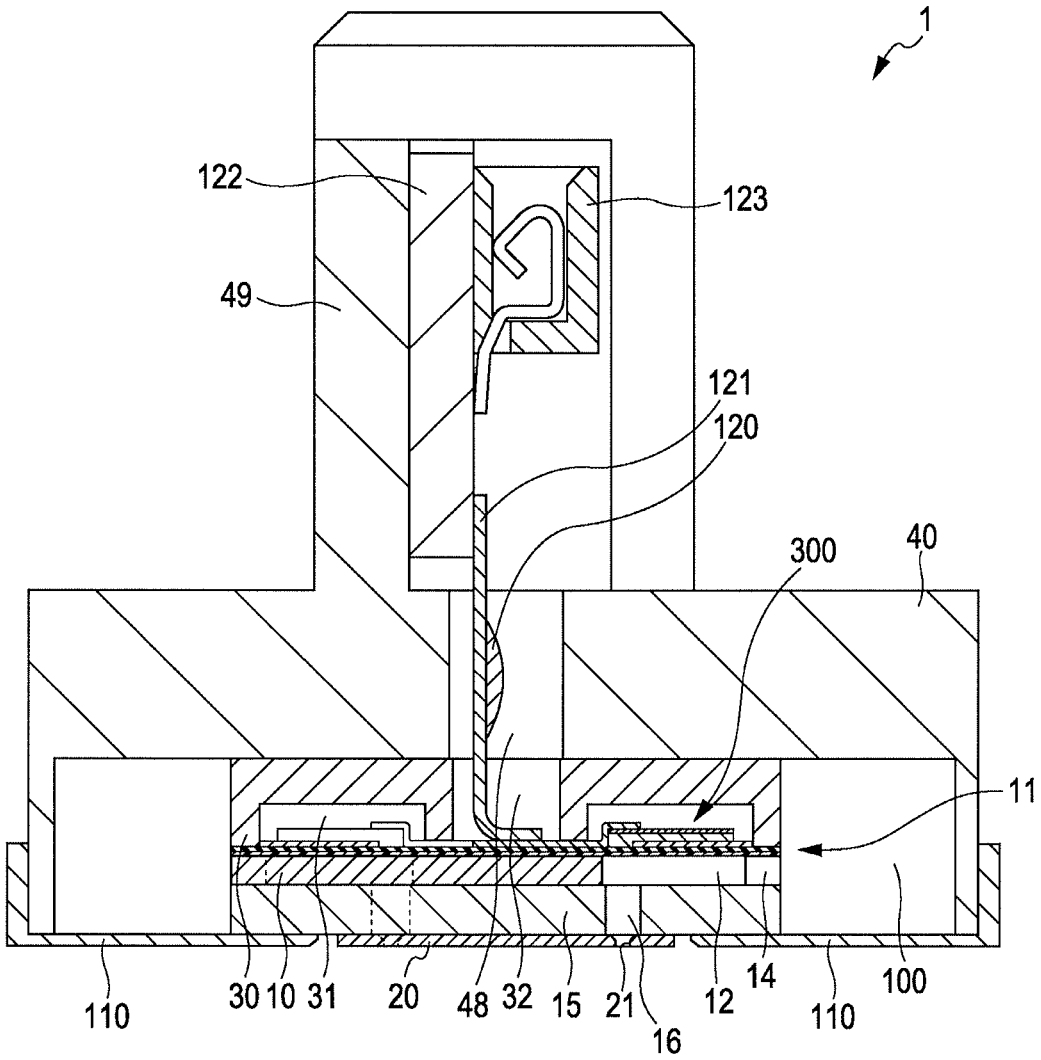
FIG. 3 is a cross-sectional view of a variation on the recording head according to the embodiment.

Although an exemplary embodiment of the invention has been described thus far, the invention is not limited to the aforementioned embodiment. The aforementioned embodiment describes the cover members 110 being provided only on the opening surface of the depression area 41 in the case member 40; however, for example, the cover members 110 configured of stainless steel (SUS) or the like may be provided continuously from the opening surface of the depression area 41 in the case member 40 to the side surfaces of the case member 40, as shown in FIG. 3. In other words, the cover members 110 may be provided so as to cover the nozzle surface side of the main head unit 11, in which the nozzles 21 are provided. Through this, the nozzle surface of the main head unit 11 can be protected by the cover members 110.

Furthermore, although the aforementioned embodiment describes an example in which thin-film piezoelectric actuators are used as the pressure generation units that cause changes in pressure within the pressure generation chambers, the configuration of the pressure generation units is not particularly limited. The pressure generation units may be, for example, longitudinally-vibrating piezoelectric actuators, thick-film piezoelectric actuators formed through a method such as applying a green sheet, or the like. Furthermore, the pressure generation units may, for example, eject liquid droplets from the nozzles using bubbles created by the heat generated by heating elements disposed within the pressure generation chambers, eject liquid droplets from the nozzles by causing a vibrating plate to deform due to the force of static electricity generated between the vibrating plate and electrodes, and so on.

Figure 4:
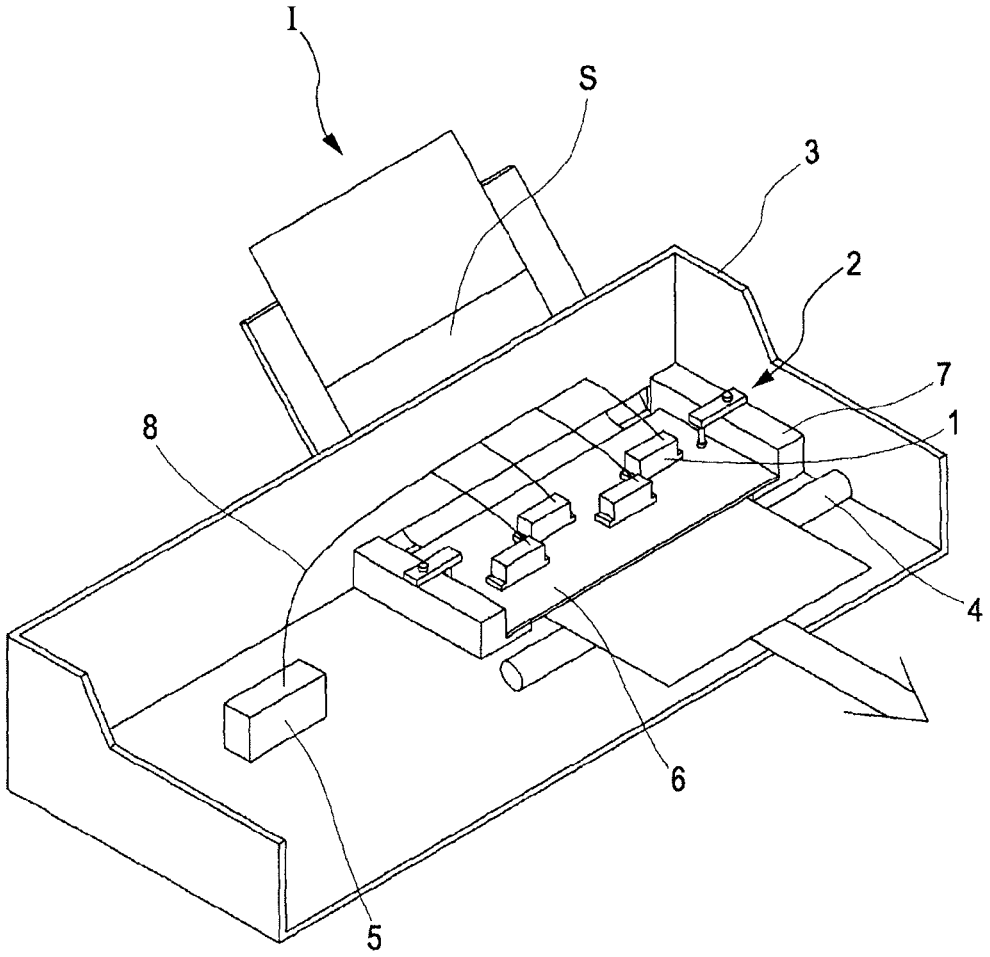
FIG. 4 is a diagram illustrating the overall configuration of a recording apparatus according to the embodiment.

Note that the aforementioned ink jet recording head configures part of an ink jet recording head unit, which in turn is mounted in an ink jet recording apparatus. FIG. 4 is a general diagram illustrating an example of such an ink jet recording apparatus.

The ink jet recording apparatus according to this embodiment is what is known as a line-type apparatus. As shown in FIG. 4, an ink jet recording apparatus I includes an ink jet recording head unit 2 (called simply a "head unit 2" hereinafter) in which is provided the ink jet recording head 1; a main apparatus unit 3; a roller 4 that supplies a recording sheet S, which serves as a recording medium; and a liquid holding unit 5.

The head unit 2 includes a plurality of the ink jet recording heads 1 and a plate-shaped base plate 6 that holds the plurality of ink jet recording heads 1. The head unit 2 is anchored to the main apparatus unit 3 via a frame member 7 that is attached to the base plate 6.

The roller 4 is provided in the main apparatus unit 3, transports the recording sheet S, which is paper or the like, that has been supplied to the main apparatus unit 3 and has passed along the nozzle surface side of the ink jet recording heads 1, and discharges the recording sheet S to the exterior of the apparatus.

Furthermore, the liquid holding unit 5 in which ink is held is anchored to the main apparatus unit 3, and is connected to the ink jet recording heads 1 via supply pipes 8 configured of flexible tubes or the like.

According to this ink jet recording apparatus I, ink is supplied to the respective ink jet recording heads 1 from the liquid holding unit 5 via the supply pipes 8, and when the recording sheet S is transported by the roller 4, the ink is ejected from the ink jet recording heads 1 in the head unit 2, and images or the like are printed on the recording sheet S as a result.

Although a single head unit 2 is provided in the ink jet recording apparatus I in this example, it should be noted that the number of head units 2 provided in the ink jet recording apparatus I is not particularly limited; a plurality of head units 2 may be provided as well.

In addition, although what is known as a line-type apparatus is given as an example of the ink jet recording apparatus here, the ink jet recording apparatus is of course not limited thereto. For example, the invention can also be applied in what is known as a serial-type ink jet recording apparatus that carries out printing while moving an ink jet recording head provided in a carriage. In this case, a liquid holding unit may be provided in the carriage along with the ink jet recording head.

Furthermore, although the aforementioned embodiments describe the invention using an ink jet recording head as an example of a liquid ejecting head, the invention is directed at all types of liquid ejecting heads and liquid ejecting apparatuses that include such liquid ejecting heads, and of course can also be applied in liquid ejecting heads and liquid ejecting apparatuses including such liquid ejecting heads that eject liquids aside from ink. Various types of recording heads used in image recording apparatuses such as printers, coloring material ejecting heads used in the manufacture of color filters for liquid-crystal displays and the like, electrode material ejecting heads used in the formation of electrodes for organic EL displays, FEDs (field emission displays) and so on, bioorganic matter ejecting heads used in the manufacture of biochips, and so on can be given as other examples of liquid ejecting heads.

What is claimed is:

1. A liquid ejecting head comprising:

a flow channel member, comprising silicon, further comprising:

a flow channel substrate defining a plurality of pressure generation chambers; and a communication plate defining a plurality of communication holes, wherein each of the communication holes is in fluid communication with a corresponding one of the pressure generation chambers;

a nozzle plate, comprising silicon, wherein the nozzle plate is affixed to a part of a surface of the communication plate, the nozzle plate defining a plurality of nozzles, wherein each of the nozzles is in fluid communication with a corresponding one of the communication holes; and a manifold member, wherein the manifold member and the flow channel member cooperate to define a manifold, wherein the manifold is in fluid communication with the plurality of pressure generation chambers and is disposed at a position along a lengthwise direction of the pressure generation chambers.

2. The liquid ejecting head according to claim 1, wherein a cross-sectional area of each of the communication holes is greater than a cross-sectional area of each of the nozzles.

3. A liquid ejecting apparatus comprising the liquid ejecting head according to claim 1.

4. The liquid ejecting head according to claim 1, wherein a length of the nozzle plate is less than a length of the communication plate, in the lengthwise direction of the pressure generation chambers.

5. The liquid ejecting head according to claim 1, wherein the manifold member is made of a different material than the flow channel member.

* * * * *